United States Patent [19]

Bächler et al.

[11] Patent Number: 4,757,689

[45] Date of Patent: Jul. 19, 1988

[54] CRYOPUMP, AND A METHOD FOR THE OPERATION THEREOF

[75] Inventors: Werner Bächler, Rösrath; Hans-Joachim Forth, Cologne; Hans-Hermann Klein, Rösrath; Wilhelm Strasser, Bergisch Gladbach, all of Fed. Rep. of Germany

[73] Assignee: Leybold-Heraeus GmbH, Cologne, Fed. Rep. of Germany

[21] Appl. No.: 922,034

[22] Filed: Oct. 22, 1986

[30] Foreign Application Priority Data

Jun. 23, 1986 [EP] European Pat. Off. ..... 86108529.8

[51] Int. Cl.[4] ..... B01D 8/00

[52] U.S. Cl. ..... 62/55.5; 55/269; 62/228.3; 417/901

[58] Field of Search ..... 62/100, 268, 228.3, 62/55.5; 55/269

[56] References Cited

U.S. PATENT DOCUMENTS 3,585,807 6/1971 Hengevoss et al. ..... 62/55.5
4,361,418 11/1982 Tscheppe ..... 62/55.5
4,667,477 5/1987 Matsuda et al. ..... 62/55.5
4,668,261 5/1987 Chatzipetros ..... 62/55.5

FOREIGN PATENT DOCUMENTS 3512614 10/1986 Fed. Rep. of Germany .

*Primary Examiner*—Ronald C. Capossela
*Attorney, Agent, or Firm*—Felfe & Lynch

[57] ABSTRACT

The invention relates to a cryopump having a casing (1), a gas inlet opening (8) to which a chamber (30) can be attached through a valve (31), a vacuum pump (18) connected through a valve (16) to the casing, a two-stage refrigerator (4) in the casing as cold source, and pumping surfaces (7, 9, 12, 13) which, on both of the refrigeration stages (5, 11) of the refrigerator, are equipped with an electrical heating means (23, 24). To achieve a great shortening of the time required for regeneration and start-up it is proposed that a sensor (41) be provided to monitor the pressure within the pump casing, and that a control unit (28) be present by which the operation of the cryopump can be monitored and controlled on the basis of the signals supplied by the sensor.

29 Claims, 1 Drawing Sheet

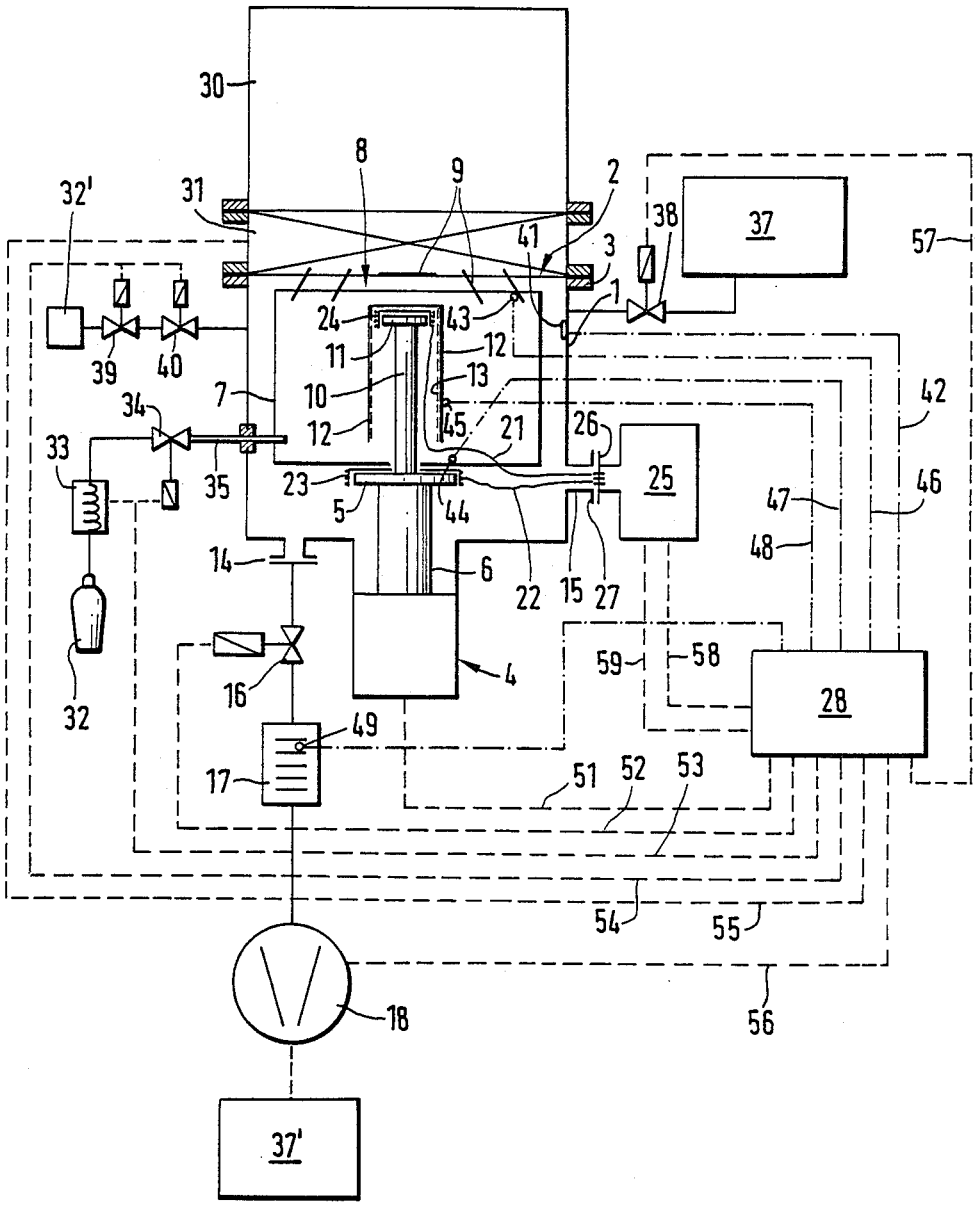
30
8
9
2
32'
31
38
37
57
41
3
1
24
43
12
11
13
39
40
10
7
42
34
12
45
21
26
33
35
23
25
47
46
5
44
48
14
6
22
15
27
59
58
4
16
28
32
49
17
51
52
53
54
55
18
56
37'

CRYOPUMP, AND A METHOD FOR THE OPERATION THEREOF

BACKGROUND OF THE INVENTION

The invention relates to a cryopump having a casing, a gas inlet to which a vacuum chamber can be connected through a valve, a vacuum pump connected to the casing through a valve, a two-stage refrigerator as cold source situated in the casing, and pumping surfaces which are equipped with an electrical heating means at both of the refrigeration stages of the refrigerator. The invention furthermore relates to a method for the operation of a cryopump of the kind specified. Operation of the cryopump is to be understood in this case to mean not only pumping and evacuation, but also regeneration.

Cryopumps, like ion getter pumps, are of a kind which do not deliver directly to the atmosphere the gases removed from a vacuum chamber but first accumulate them on the pumping surfaces. When their pumping capacity is reached, it is necessary to regenerate the pumping surfaces, that is, to remove the gases that are on the pumping surfaces. This can be accomplished, for example, by shutting off the refrigerator after the valve to the vacuum chamber has been closed or after the preferably heated gases flow through the pump. The warm gases are intended to warm the pumping surfaces and carry away the gases that are set free. In another regenerating method (disclosed in the German published patent application No. P 35 12 614.0) the pumping surfaces are heated by an electrical heating means on the pump surfaces. The liberated gases are pumped away by means of a forepump connected to the pump casing.

The regeneration of cryopumps involves a number of difficulties. On the one hand, it is not always easy to know when the mixture capacity of a cryopump is reached. It is especially difficult to know whether any residual capacity still available will suffice for the next pumping cycle. This problem is present, for example, in the use of cryopumps on vapor depositing or sputtering systems. In systems of this kind a batch is placed in a vacuum chamber which is then evacuated by means of the cryopump. Then reactive gases and/or inert gases are additionally admitted, up to a pressure at which the coating of the parts is performed. After the admission of gas has been interrupted, the remaining gases are removed in order to check the previous vapor depositing step. Then the vacuum chamber is separated from the cryopump and aired for the next batch. Whether the cryopump still has sufficient capacity after the last evacuation can be learned only with difficulty. Usually, for reasons of safety, a regeneration is started long before the maximum capacity is reached. For this period of time the operation of the system must be interrupted.

Furthermore, it is difficult to know when a regeneration has ended, i.e., when the pumping surfaces are completely freed of the gases by heating. It is therefore common practice to assume maximum plate loading and to heat for a corresponding length of time. This, however, involves the disadvantage that the cryopump is unavailable for the evacuating operation for a relatively long time, and thus the whole system to which the cryopump is attached often is out of operation for an unnecessarily long time.

The present invention is addressed to the problem of equipping a cryopump of the kind described above with monitoring and controlling systems such that the time expended for regeneration purposes is minimized.

SUMMARY OF THE INVENTION

In accordance with the invention this problem is solved, in a cryopump of the kind specified above, by providing a sensor to determine the pressure within the pump casing, and by providing a control unit whereby the operation of the pump is monitored and controlled according to the signals supplied by the sensor. Preferably, the means forming the control unit are selected such that automatic operation, especially operation of the regenerating phase, will be possible. In an especially desirable embodiment, a microprocessor is provided which starts and controls an optimally short regenerating process on the basis of the signals supplied by the sensor.

An important advantage of a cryopump configured according to the invention is that, by means of the signals supplied by the pressure sensor and a suitably programmed microprocessor, relatively accurate criteria can be obtained of the pumping capacity still available. If, for example, during an evacuating process the time is measured which the cryopump needs to achieve a certain pressure, conclusions can be derived from the measured time as to the pumping capacity still available. If a certain amount of time is exceeded, an automatically performed regenerating process can be started, in which the necessary actions can be initiated by the control unit or microprocessor. The state of the pump can be determined on the basis of a dp/dt measurement (change of pressure with time).

On the basis of what is learned about the capacity still available it is furthermore possible to arrive at the degree to which the pumping surfaces are occupied by gases, so that it is not necessary always to regenerate for the maximum length of time. To achieve an optimally short regenerating phase, however, it is desirable to provide additional sensors whereby the freedom of a pumping surface from the gases can be ascertained. Desirable for this purpose are temperature sensors which are fastened to the pumping surfaces.

If a cryopump of the kind according to the invention is operated such that, on the basis of the data delivered by the sensor or sensors, the pumping speed and with it the still-available pumping capacity of the cryopump is monitored and, if it is no longer sufficient for the next pumping cycle, an automatically controlled regenerating process is initiated, then this cryopump can be operated in an optimum manner, i.e., with pumping phases of maximum length or pumping cycles of maximum frequency, and with the shortest possible regenerating phases. Thus the idle time of apparatus to which cryopumps of the kind according to the invention are connected is optimally short. The cryopump can be included in the automatically controlled operation of an apparatus. The constant presence of operating personnel is no longer necessary. Overnight operation of the pump or of the apparatus connected to it is also possible.

Other advantages and details of the invention are now to be explained with the aid of an embodiment represented in the figure.

BRIEF DESCRIPTION OF THE DRAWING

The single FIGURE is a schematic diagram of a cryopump system including the sensing and control devices according to the present invention.

DESCRIPTION OF THE PREFERRED EMBODIMENT

In the FIGURE is shown a cryopump having a casing 1 which has a port 2 for the entry of the gases to be pumped out. The chamber 30 which is to be evacuated is attached to the flange 3 through a shut-off means 31 so that the cryopump can be cut off from the chamber 30 for start-up and for regeneration.

A two-stage refrigerator 4 extends from below into the casing. On the first stage 5 of the refrigerator 4 there is mounted for good thermal conduction an additional, substantially pot-like casing 7 whose port 8, which is approximately parallel with the mouth 2 of the casing 1, is covered by metal strips forming a baffle 9 which serves for shielding. The walls of the casing 7 take on a temperature, during the pumping operation (when refrigerator 4 is turned on), of about 60 to 100 K and serve as pumping surfaces for water vapor and carbon dioxide (by cryocondensation).

Moreover the shape of the pot 7 is selected such that the pot together with the baffle 9 shields the components disposed therein against external heat rays in the best possible manner.

The second stage 10 of the refrigerator 4 projects into the pot-like casing 7 and bears at its cold end 11 the pumping surfaces 12. These often consist of two flat sections of sheet metal disposed parallel to one another. To increase the surface area and improve the pumping of light gases, the sheet metal sections are covered on their inner sides with the adsorption material 13. This best consists of molecular sieve, active carbon, or zeolite. On the outer sides of the pumping surfaces 11 the attachment of gases ($N_2$, Ar, CO, methane or the like) takes place by cryocondensation or cryotrapping. The light gases ($H_2$, He) preferentially land on the inner sides of the pumping surfaces where they are bound by cryosorption.

On the casing 1 of the cryopump there are provided two additional connections 14 and 15. The forepump 18, preferably a rotary valve pump with an end pressure of about $10^{-3}$ mbar, is connected to the connection 14 through a vane 16 and an adsorption trap 17.

The connection 15 serves for the lead-through of conductors 21 and 22 through which the heaters 23 and 24, consisting of resistance wires and disposed on the refrigeration stages 5 and 11, are supplied with current. The connection 15 can furthermore serve for the mounting of a power supply unit 25 having a control with which the maximum permissible temperature of the heaters 23 and 24 can be adjusted and sustained or regulated. For this purpose the casing of the apparatus 25 has a blind flange 26 with a power lead-through which is fastened to the flange 27 of the connection 15. By this system it is brought about that it is not possible for the user of the cryopump to operate it without regulated heating. Removal of the unit from the housing signifies a venting of the pump, so that it can no longer serve its function.

Also represented diagrammatically is a control unit identified as 28. It contains known programmable control means (e.g., a microprocessor) capable of putting out controlling signals on the basis of signals supplied by sensors to be described in detail below, by which the operation of the cryopump is automatically controllable.

Means are furthermore associated with the cryopump shown in the drawing, which enable it to cause gases (heated inert gases or air) to flow through the casing 1. These means include the gas bottle 32, the heating means 33, and the valve 34 by which the feeding of the gas through the tube 35 is controllable. The tube 35 passes through the casing wall of the pump and the cylinder 7, so that the entering gases impinge directly on the pumping surfaces. The gas outlet is identified by 36 and leads through the valve 38 back into the open air or into a receiver 37. The latter is necessary only when environmentally harmful gases are to be removed from the pumping surfaces. In this case a receiving tank 37' is best associated also with the outlet of the vacuum pump 18 and can be identical to the receiver 37.

Lastly, means are also associated with the pump which enable a relatively small, specific amount of gas to be admitted into the casing 1. These means include, for example, two valves 39 and 40 which between them define the fixed gas volume and which are actuated in appropriate sequence to admit the gas. The volume between the valves 39 and 40 is filled from the supply chamber 32'.

To start up the cryopump, first the shuf-off means 31 between the casing 1 of the pump and the chamber 30 which is to be evacuated is closed. Then the casing 1 of the pump is evacuated by means of the vacuum pump 18 to a pressure of $10^{-2}$ to $10^{-2}$ mbar. At the same time the heaters 23 and 24 are turned on so that the pumping surfaces 7 and 12 are heated to the desired temperatures (70° C.). This state is maintained until the pressure in casing 1 amounts to $<10^{-2}$ mbar. The refrigerator 4 can now be turned on. Then, first the heater 23 of the first stage 5 of the refrigerator 4 is shut off. The pumping surface 7 thus turns cold and pumps the $H_2O$ vapor that is still present. After this step the heater 24 of the refrigerator stage 11 is shut off, so that the pumping surfaces 12 can assume their working temperature of approximately 12 K. Then the chamber 30 is connected to the cryopump, i.e., the shut-off means 31 is opened. These steps can be performed automatically if the microprocessor in the control unit is programmed accordingly. Since the sensors 41, 43, 44 and 45 are constantly emitting signals on the state of the pump, the individual steps can be terminated as soon as the desired state is reached. The starting up of the pump in operation can therefore be accomplished in an optimally short period of time.

Furthermore, this method of procedure has the advantage that, in the first cooling phase in which vapors are produced, the vapors are prevented from accumulating on the adsorption surfaces of the second stage and drastically reducing their capacity. Most of the vapors therefore deposit themselves first only on the pumping surfaces 7. Not until light gases, preferably helium, are to be preferentially pumped, do the pumping surfaces 12 cool down to their working temperature, so that the full pumping capacity is available thereon.

To permit automatic operation of the cryopump by means of the control unit 28 it is necessary to feed data signals to the latter. Several sensors are provided for this purpose. In detail, they are the pressure sensor 41 which supplies signals corresponding to the pressure in the pump casing 1 through the line 42 to the control unit 28. Temperature sensors 43, 44 and 45 are fastened to the inner wall of the casing 1 and on the pumping surfaces 7, 9, 12 and 13. They are connected to the control unit by the lines 46, 47 and 48. The adsorption trap 17 can also be equipped with a temperature sensor 49, so that its state of operation can be monitored during the heating-out process. All lines via which the signals are fed to the control unit 28 are represented in dash-dotted lines.

On the basis of the signals being fed to it, the control unit initiates the necessary actions. According to needs, it actuates the refrigerator 4 through control line 51, the valve 16 through control line 52, the valves 34 as well as the heating means 33, if present, through control line 53, the valves 39 and 40 through control line 54, the valve 31 through control line 55, the forepump through control line 56, and valve 38 to the receiver 37. Lastly, the control unit 28 is connected to the power supply unit 25 for the cold heaters 23 and 24 through the control lines 58 and 59, so that the heaters can be turned on separately or together. The control lines are all represented in broken lines.

The control unit 28 has the purpose, among others, of initiating the regeneration of the pumping surfaces 7, 9, 12 and 13 when it is desired or when the capacity of the pumping surfaces is reached or nearly reached. If the regenerating process is to be started automatically, it is first necessary that the condition of need for regeneration is registered by the control unit 28. One possibility for this consists in the recurrent measurement of the time in which the cryopump, after venting or pressure elevation in the chamber 30, reaches a specific pressure, for example a pressure of $5\times10^{-7}$ mbar within 30 seconds. If this time is exceeded, then, if the other parameters are appropriate (size of the chamber, pump capacity), it can be concluded that the capacity of the pumping surfaces has been reached. Another possibility consists in putting pressure and time measurements in relation to one another during recurrent evacuation processes and, with the aid of dp/dt values which can be computed by the microprocessor, to determine the still-available capacity of the pump. It is particularly expedient to make use of these possibilities whenever the operation of a system calls for recurrent evacuation processes anyway, which then can serve simultaneously for the measurement of the time or of the dp/dt ratio.

In the case of cryopumps which are connected substantially continuously to a chamber, the loading of the pumping surfaces of the second stage can be determined by the constant registration of the temperature of these pumping surfaces. If, for example, the pumping surface 12 of the second stage, which in the case of a freshly regenerated pump assumes a temperature of about 12 K., takes on a temperature of 18 K., the regenerating process is initiated.

Another possibility consists in closing the valve 31 between chamber and pump at intervals of time, letting a relatively small, known amount of gas into the pump casing by means of valves 39 and 40, and again performing the above-described measurements of time or dp/dt ratio.

If the need for regeneration is determined by the microprocessor in the control unit 28, the regenerating process is then initiated automatically. This is done in the following steps:

1. The shut-off means 31 of the chamber 30 is closed.
2. The refrigerator 4 is turned off.
3. The heaters of the first and second stages are turned on.
4. The preliminary vacuum valve 16 is opened when a pressure is signaled by the sensor 41 which is, for example, greater than 1 millibar.
5. The heaters are operated at 70° C. until a pressure of $<5\times10^{-2}$ is established in the pump.
6. The fore valve 16 is closed.
7. The heater of the first stage is turned off.
8. The refrigerator is turned on so that the first stage cools down to a temperature $<160$ K.
9. The heater 24 of the second stage 10 is shut off so that the second stage cools down to a temperature $<20$ K.
10. The shut-off means 31 of the chamber 30 is opened.

The sensors 41 43, 44 and 45 are being constantly scanned, so that immediately after the specified pressures and temperatures are reached, the next step can be initiated. The regeneration times are thus optimally short. This is also true in the case in which a pump which has not yet reached its maximum capacity is to be regenerated immediately. The regenerating process is then to be initiated manually from the control unit.

A conditioning or regeneration of the cryopumps after pumping He and $H_2$ is performed by the following steps:

1. The shut-off means 31 is closed.
2. The heater 24 of the second stage 10 is turned on with the refrigerator running, and one waits until, at a heating temperature of 70 K., monitored by the sensor 45, a pressure of about 1 mbar (sensor 41) has established itself in the casing of the pump.
3. The fore vacuum valve 16 is opened and the heater 24 of the second stage is shut off until a pressure of about $1\times10^{-2}$ mbar is reached.
4. The fore vacuum valve 16 is closed.
5. The shut-off means 31 to the chamber 30 is opened after the temperature and the second refrigerator stage has fallen below 20 K.

In this partial regeneration the sensors in question also constantly supply signals on the current state to the control unit 28, so that, after an optimally short time, the surfaces absorbing He and $H_2$ are regenerated and available.

In this regenerating process, use is made of the possibility that exists in two-stage refrigerators of keeping the pumping surfaces of the first stage at their working temperatures while the pumping surfaces of the second stage are being heated up. The reason for this is that the thermal conductivity between refrigeration stage 5 of the first stage and the refrigeration stage 11 of the second stage of the refrigerator is very small, so that heating the second stage has a negligible influence on the temperature in the area of the first stage.

Through the selection of a higher heating temperature ($T>120$ K.) at the second stage, the gases bound to the pumping surfaces 12 by cryocondensation or cryotrapping are removed independently of those on the pumping surfaces 7 of the first stage.

Another important advantage of the use of the programmable control unit 28 is that, since the state in the pump casing is constantly monitored by the sensors, the regeneration process can be performed in such a manner as to reliably prevent liquefaction of the condensed gases during the regenerating phase. This can be achieved, for example, by keeping the pressure in the pump always slightly below the sublimation point. By controlling the electrical heat input depending on the pressure or by the dosed admission of regenerating gases it is possible to satisfy this condition. The valve 34 must be in the form of a control valve in the case of such proportioned admission of regenerating gas.

If the danger exists that explosive gas mixtures might collect in the pump, the development of an actual risk of explosion can be avoided by means of the microprocessor. The pressure in the pump can be kept, for example, at a level at which the gas mixture is not explosive. For example, an $H_2/O_2$ mixture is not explosive at a pressure below 14 mbar. If the regeneration of the cryopump is performed such that, beginning at about 10 mbar, all current-carrying parts, such as for example heaters 23 and 24, and any ionization or thermal conduction vacuum meters, are shut off, any danger of explosion is then also avoided.

Explosive gas mixtures can first be diluted, e.g., by the admission of inert gas (Ar, $N_2$) from the bottle 32 through the heater 33, the valve 34 and the tube 35, and can then be removed from the pump. The gas mixture is either forced by light pressure through the valve 38 into the receiver 37, or it is pumped by means of the forepump 18 through valve 16 into the receiver 37'. The temperature sensors 44, 45 and 43 indicate when the admission of gas can be interrupted. After valve 34 has closed, valve 16 is opened in order to evacuate the cryopump to its starting pressure ($<5\times10^{-2}$ mbar).

A typical procedure without the aid of the forepump 18 is the following:

1. Close valve 31.
2. Turn off refrigerator 4.
3. Let in gas from the gas bottle 32 through valve 34 (open).
4. At a pressure of approximately 1050 mbar, open valve 38 and feed the gas mixture into 37.
5. Stop admitting gas when sensor 45 indicates a sufficiently high temperature. ($T\approx70$ K. in the case of $H_2$ regeneration, $T\approx150$ K. in the case of $CH_4$ regeneration)
6. Evacuate the pump with the forepump to $p<5\times10^{-2}$ mbar.

Then, if only $H_2$ or $CH_4$ are to be removed, the pump can be started up again, doing so by the following steps:

7'. Start refrigerator 4 (with valve 16 closed).

8'. Open valve 31 at $T\leqq20$ K. (sensor 45) at the second refrigerator stage.

If the pump is to be completely regenerated, then the following steps are added:

7". Regenerating heaters on.

8". Heat the pump parts to $T>300$ K. (sensors 43, 44, 45).

At $p>8\times10^{-2}$ mbar the valve 16 should be open, and at $p<5\times10^{-3}$ mbar it should be closed.

9". Heaters off, and start refrigerator.

Instead of step 9", steps 7 to 10 as previously described can also be performed.

The procedure described is desirable in the case of the removal of explosive or toxic gases which are trapped in the receiver 37 and diluted by the regenerating gas. Corrosive gases do not reach the forepump.

If this precaution is not necessary, the forepump can be used during the regeneration and the following procedure, for example, can be used:

1. Close valve 31.
2. Turn off refrigerator 4.
3. Admit gas from the gas bottle 32 through valve 34 (open).
4. Open valve 16 at about $8\times10^{-2}$ mbar.

In case only $H_2$ or $CH_4$ are to be removed:

5'. Interrupt admission of gas when sensor 45 signals a sufficiently high temperature ($T\approx70$ K. for $H_2$ regeneration, $T\approx150$ K. for $CH_4$ regeneration), 6'. Close valve 16.

7'. Refrigerator on.

8'. Open valve 31 at $T\leqq20$ K.

If the pump is to be completely regenerated:

5". Turn on regeneration heaters.

It is then best to add steps 5 to 10 as previously described.

There has thus been shown and described a novel cryopump, and a method for the operation thereof, which fulfills all the objects and advantages sought therefor. Many changes, modifications and variations and other uses and applications of the subject invention will, however, become apparent to those skilled in the art after considering this specification and the accompanying drawing which disclose the preferred embodiment thereof. All such changes, modifications, variations and other uses and applications which do not depart from the spirit and scope of the invention as deemed to be covered by the invention which is limited only by the claims which follow.

We claim:

1. In a cryopump having a casing, a gas inlet to which a vacuum chamber can be connected through a first valve, a vacuum pump connected to said casing through a second valve, a two stage refrigerator as a cold source situated in said casing and having two refrigeration stages with pumping surfaces thereon, and electrical heating means associated with said pumping surfaces, the improvement comprising first sensor means, located in said casing, for producing a first signal responsive to the pressure within said casing and control means, connected to said first sensor means, for controlling the operation of the cryopump in response to said first signal.

2. The cryopump according to claim 1, wherein said control means includes means for automatically operating said cryopump through evacuation and regeneration phases.

3. The cryopump according to claim 1, further comprising a power supply for said electrical heating means and control lines connecting said control means with said power supply, and wherein said control means controls the application of power to said electrical heating means.

4. The cryopump according to claim 1, further comprising at least one second sensor means for producing a second signal responsive to the temperature of at least one pumping surface of at least one stage of said refrigerator, and wherein said control means is connected to said second sensor means and is operative to control the operation of the cryopump in response to said second signal.

5. The cryopump according to claim 1, further comprising a first gas source and a third valve connecting said first gas source with said casing, and wherein said control means is connected to, and operative to control said third valve to supply regenerating gases to said casing.

6. The cryopump according to claim 1, further comprising a second gas source and two fourth valves connected in series between said second gas source and said casing, and wherein said control means is connected to, and operative to control said fourth valves for supplying a small amount of gas with a specific volume to said casing.

7. The cryopump according to claim 1, wherein said vacuum pump is connected through a fifth valve to said casing, and wherein said control means is connected to, and operative to control said fifth valve.

8. The cryopump according to claim 7, further comprising an absorption trap, connected between said vacuum pump and said fifth valve, and third sensor means, connected to said control means, for producing a third signal responsive to the temperature in said absorption trap, and wherein said control means is connected to said third sensor means and is operative to control the operation of the cryopump in response to said third signal.

9. The cryopump according to claim 1, further comprising means for receiving regenerating gases discharged from said cryopump.

10. The cryopump according to claim 9, wherein said gas receiving means is connected to the outlet of said vacuum pump.

11. The cryopump according to claim 9, wherein said gas receiving means includes a gas receiving tank and a sixth valve connected between said gas receiving tank and said casing, said control means being connected to, and operative to control said sixth valve.

12. A method for operating a cryopump having a casing, a gas inlet to which a vacuum chamber can be connected through a first valve, a vacuum pump connected to said casing through a second valve, a two stage refrigerator as a cold source situated in said casing and having two refrigeration stages with pumping surfaces thereon, and electrical heating means associated with said pumping surfaces, the method comprising the steps of:

(a) monitoring the remaining pumping capacity of said cryopump by means of at least one pressure sensor means located in said casing, and (b) when the pumping capacity of said cryopump is no longer sufficient for the next pumping cycle, automatically initiating the regeneration process by means of cryopump control means in response to said pressure sensor.

13. The method according to claim 12, further comprising the step of automatically running the start-up phase of said cryopump by means of said control means in response to the signals supplied by said sensor means.

14. A method of operating the cryopump according to claim 12, comprising the step of maintaining the pressure in the cryopump during the regeneration processes below the pressure at which a danger of explosion begins, when the cryopump contains explosive gases or gas mixtures.

15. The method according to claim 12, wherein the remaining pumping capacity of said cryopump is determined by repeatedly measuring its pumping speed.

16. The method according to claim 15, wherein said still remaining pumping capacity is determined by repeatedly measuring the time which the cryopump requires to reach a specific pressure, and wherein said regenerating process is initiated if this time exceeds a prescribed limit.

17. The method according to claim 15, wherein said pumping speed of the cryopump is determined by dp/dt measurements made during the evacuation process.

18. The method according to claim 15, wherein said still remaining pumping capacity is determined by introducing a specific amount of gas into said casing with said casing closed off from said vacuum chamber and said vacuum pump by said first and second valves, respectively, and performing dp/dt measurements on the gas in said casing.

19. The method according to claim 15, wherein the temperature of the pumping surfaces of the second refrigeration stage is monitored to determine the pumping capacity of the cryopump.

20. A method of operating the cryopump according to claim 12, comprising the step of heating said pumping surfaces to a temperature of about 70 K., thereby to remove He and $H_2$.

21. The method according to claim 20, wherein said pumping surfaces are heated with said refrigerator running.

22. A method of operating the cryopump according to claim 12, comprising the step of heating said pumping surfaces to a temperature of about 150 K., thereby to remove $N_2$, Ar and other gases.

23. A method of operating the cryopump according to claim 21, comprising the step of maintaining the pressure in the cryopump during the regenerating processes, below the sublimation point of condensable gases present in the cryopump.

24. A method of operating the cryopump according to claim 12, comprising the step of controlling the pressure in said cryopump during the regenerating processes in dependence upon the heat input of the cryopump.

25. A method of operating a cryopump according to claim 12, comprising the step of controlling the pressure in said cryopump during the regenerating processes by means of a controlled admission of regenerating gases into said casing.

26. A method of operating a cryopump according to claim 12, comprising the steps of monitoring the pressure in the cryopump during the regenerating processes if explosive gases or gas mixtures are present in the cryopump, and switching off all current carrying elements in the cryopump at a prescribed pressure below the pressure at which a danger of explosion begins.

27. A method for operating a cryopump according to claim 12, comprising the steps of heating the pumping surfaces to effect regeneration of the cryopump.

28. The method according to claim 27, further comprising the step of admitting regenerating gases into said casing to effect regeneration of said cryopump.

29. A method for operating the cryopump according to claim 12, comprising the step of admitting regenerating gases into said casing to effect the regeneration of said cryopump.

* * * * *

US004757689B1

REEXAMINATION CERTIFICATE (2936th)

United States Patent [19]

Bächler et al.

[11] B1 4,757,689

[45] Certificate Issued Jul. 2, 1996

[54] CRYOPUMP, AND A METHOD FOR THE OPERATION THEREOF

[75] Inventors: Werner Bächler, Rösrath; Hans-Joachim Forth, Cologne; Hans-Hermann Klein, Rösrath; Wilhelm Strasser, Bergisch Gladbach, all of Germany

[73] Assignee: Leybold Aktiengesellschaft, Cologne, Germany

Reexamination Request:
No. 90/003,962, Sep. 21, 1995

Reexamination Certificate for:

| | |
|---|---|
| Patent No.: | **4,757,689** |
| Issued: | **Jul. 19, 1988** |
| Appl. No.: | **922,034** |
| Filed: | **Oct. 22, 1986** |

[30] Foreign Application Priority Data

Jun. 23, 1986 [EP] European Pat. Off. ..... 86108529.8

[51] Int. Cl.[6] ..... B01D 8/00

[52] U.S. Cl. ..... 62/55.5; 55/269; 62/228.3; 417/901

[58] Field of Search ..... 62/55.5, 228.3; 417/901; 55/269

[56] References Cited

U.S. PATENT DOCUMENTS

| | | | |
|---|---|---|---|
| 3,585,807 | 6/1971 | Hengevoss et al. | 62/55.5 |
| 4,361,418 | 11/1982 | Tscheppe | 62/55.5 |
| 4,667,477 | 5/1987 | Matsuda et al. | 62/55.5 |
| 4,668,261 | 5/1987 | Chatzipetros et al. | 62/55.5 |
| 5,375,424 | 12/1994 | Bartlett et al. | 62/55.5 |

FOREIGN PATENT DOCUMENTS

| | | |
|---|---|---|
| 3512614 | 10/1986 | Germany . |
| 57-146072 | 9/1982 | Japan . |
| WO84/00404 | 2/1984 | WIPO . |

OTHER PUBLICATIONS

John Ehmann, "Regeneration of High-Vacuum Cryopumps"–Solid State Technology/Apr. 1982, pp. 235–239.

John F. Peterson et al, "Vacuum Pump Technology; A Short Course on Theory and Operations", Solid State Technology/Jan. 1982, pp. 104–110.

*Primary Examiner*—Ronald C. Capossela

[57] ABSTRACT

The invention relates to a cryopump having a casing (1), a gas inlet opening (8) to which a chamber (30) can be attached through a valve (31), a vacuum pump (18) connected through a valve (16) to the casing, a two-stage refrigerator (4) in the casing as cold source, and pumping surfaces (7, 9, 12, 13) which, on both of the refrigeration stages (5, 11) of the refrigerator, are equipped with an electrical heating means (23, 24). To achieve a great shortening of the time required for regeneration and start-up it is proposed that a sensor (41) be provided to monitor the pressure within the pump casing, and that a control unit (28) be present by which the operation of the cryopump can be monitored and controlled on the basis of the signals supplied by the sensor.

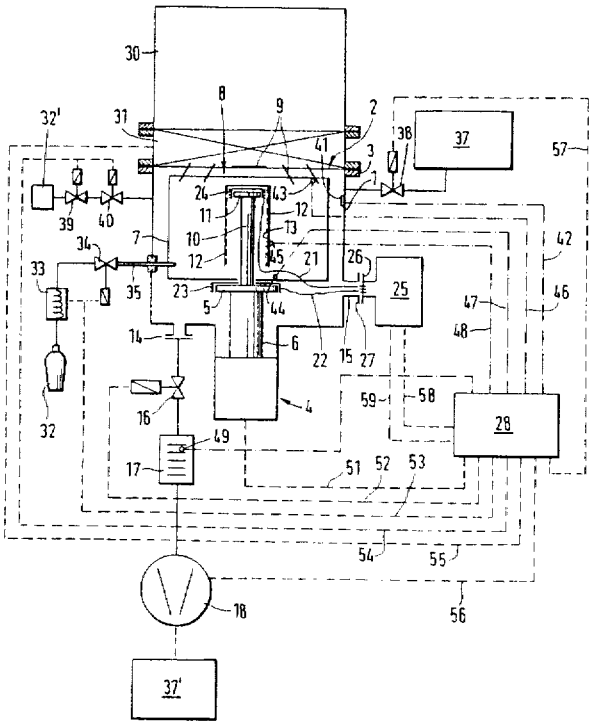

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 4, 5, 9–29 is confirmed.

Claims 1–3 are cancelled.

Claims 6 and 7 are determined to be patentable as amended.

Claim 8, dependent on an amended claim, is determined to be patentable.

New claims 30–34 are added and determined to be patentable.

6. The cryopump according to claim [1] *5*, further comprising a second gas source and two fourth valves connected in series between said second gas source and said casing, and wherein said control means is connected to, and operative to control said fourth valves for supplying a small amount of gas with a specific volume to said casing.

7. The cryopump according to claim [1] *6*, wherein said vacuum pump is connected through a fifth valve to said casing, and wherein said control means is connected to, and operative to control said fifth valve.

*30. A cryopump comprising*

*(a) a casing;*

*(b) a gas inlet to which a vacuum chamber can be connected;*

*(c) a first valve for connecting the gas inlet to the vacuum chamber;*

*(d) a vacuum pump;*

*(e) a second valve connecting said vacuum pump with said casing;*

*(f) a refrigerator situated in said casing and including first and second refrigeration stages having pumping surfaces thereon;*

*(g) electric heating means associated with said pumping surfaces;*

*(h) pressure sensor means located in said casing for producing a pressure signal responsive to the pressure within said casing;*

*(i) first control means connected to said pressure sensor means for controlling the operation of the cryopump in response to said pressure signal; and*

*(j) second control means for controlling said electric heating means.*

*31. The cryopump according to claim 30, wherein said heating means comprises a separate electric heater associated with said first and second refrigeration stages for heating the pumping surfaces thereof; and further wherein said second control means control the separate electric heaters.*

*32. The cryopump according to claim 30, further comprising first and second temperature sensors disposed at said first and second refrigeration stages, respectively, for emitting first and second temperature signals responsive to the temperature of the pumping surfaces of said first and second refrigeration stages, respectively.*

*33. The cryopump according to claim 32, further comprising means for applying said first and second temperature signals to said second control means.*

*34. The cryopump according to claim 32, further comprising means for applying said pressure signal to said second control means.*

* * * * *